US005928062A

United States Patent [19]

Miller et al.

[11] Patent Number: 5,928,062

[45] Date of Patent: Jul. 27, 1999

[54] VERTICAL POLISHING DEVICE AND METHOD

[75] Inventors: Matthew Kilpatrick Miller, Burlington; Matthew Jeremy Rutten, Milton; Terrance Monte Wright, Williston, all of Vt.

[73] Assignee: International Business Machines Corporation, Armonk, N.Y.

[21] Appl. No.: 08/846,979

[22] Filed: Apr. 30, 1997

[51] Int. Cl.[6] ..... B24B 1/00

[52] U.S. Cl. ..... 451/41; 451/285; 451/287

[58] Field of Search ..... 451/56, 285, 286, 451/287, 288, 289, 41, 42, 271, 270, 166, 36, 397

[56] References Cited

U.S. PATENT DOCUMENTS

| | | | |
|---|---|---|---|
| 2,933,437 | 5/1960 | Loosme . | |
| 3,748,677 | 7/1973 | Frank et al. . | |
| 4,208,760 | 6/1980 | Dexter et al. | 15/302 |
| 4,393,628 | 7/1983 | Ottman et al. . | |
| 4,481,741 | 11/1984 | Bouladon et al. . | |
| 4,586,296 | 5/1986 | Saunders | 451/262 |
| 4,934,102 | 6/1990 | Leach et al. . | |
| 5,012,618 | 5/1991 | Price et al. | 451/302 |
| 5,081,051 | 1/1992 | Mattingly et al. | 451/56 |
| 5,152,104 | 10/1992 | Wood et al. | 451/288 |
| 5,317,778 | 6/1994 | Kudo et al. . | |
| 5,456,627 | 10/1995 | Jackson et al. | 451/56 |
| 5,468,302 | 11/1995 | Thietje . | |
| 5,482,497 | 1/1996 | Gonnella et al. | 451/57 |
| 5,486,129 | 1/1996 | Sandhu et al. . | |
| 5,498,196 | 3/1996 | Karlsrud et al. . | |
| 5,520,573 | 5/1996 | Sumita et al. | 451/262 |
| 5,643,067 | 7/1997 | Katsuoka et al. | 451/56 |
| 5,664,987 | 9/1997 | Renteln | 451/56 |
| 5,665,201 | 9/1997 | Sahota | 451/56 |
| 5,702,292 | 12/1997 | Brunelli et al. | 451/287 |
| 5,720,652 | 2/1998 | Steinwender et al. | 451/262 |

*Primary Examiner*—David A. Scherbel
*Assistant Examiner*—Derris Holt Banks
*Attorney, Agent, or Firm*—Schmeiser, Olsen & Watts; Howard J. Walter, Jr.

[57] ABSTRACT

The present invention relates to a chemical mechanical polishing (CMP) machine and method in which at least one polishing device is provided with a vertically-oriented polishing surface and a slurry delivery mechanism. As a result, the footprint of the machine is greatly reduced and the prevention of contaminants embedding in the polishing device can be promoted.

29 Claims, 5 Drawing Sheets

VERTICAL POLISHING DEVICE AND METHOD

BACKGROUND OF THE INVENTION

1. Technical Field

The present invention relates generally to a chemical mechanical polishing (CMP) machine and method. More specifically, the present invention relates to a machine and method for polishing semi-conductor wafers using a vetically-oriented polisher.

2. Background Art

Current CMP tool design, as shown in FIG. 1, usually includes one or more horizontally-oriented polishing pads 90 which are rotated and saturated with a slurry solution as a rotating wafer is pressed into contact with the pad. As the pad rotates, the wafer is polished. However, due to the large footprint and the high number of required machines, CMP processing takes up very large amounts of manufacturing floor space.

Furthermore, since the pads are oriented horizontally, contaminants, such as pad debris, film residuals, slurry agglomerations, and other foreign material, which can scratch the wafer, is less easily removed from the horizontal pad surface.

SUMMARY OF THE INVENTION

It is an aspect of the present invention to provide a unique apparatus to solve the above-noted problems. In the present invention, a polishing device for semi-conductor wafers is provided including at least one vertically oriented polishing surface and a slurry delivery mechanism to deliver slurry onto the at least one polishing surface. Since the present invention is provided with a polishing surface which is vetically-oriented, the depth of the machine can be reduced up to 50% of that of its predecessors. The polishing device, according to the present invention, therefore, allows for up to a 33% increase in the number of machines to be used within a given amount of space. Hence, the present invention saves a semi-conductor manufacturer in space required for the polishing process.

In accordance with the present invention, the polishing surface may take a variety of forms. In particular, it is envisioned that the polishing surface can be either a polishing pad or a linear belt. In the alternative that a polishing pad is used in accordance with the present invention, the polishing pad is mounted to a substantially circular platen which is supported by a substantially horizontal bearing. The platen is radially driven by a motor through a transmission. Slurry is delivered to the rotating polishing pad via a slurry delivery mechanism which assures an even coating of slurry radially across the polishing pad.

The slurry delivery mechanism can also take a variety of forms. For example, the mechanism can be provided in the form of a spray nozzle including many heads. Alternatively, the mechanism can be provided with a slurry drip mechanism in the form of a bar with a plurality of holes to allow the slurry to drip onto the polishing pad. To assure an even coating, a squeegee to spread the slurry evenly across the polishing surface can be provided for either alternative of delivery mechanism.

The polishing device in accordance with this invention also, advantageously may include a polishing surface conditioner. In the alternative that a polishing pad is used, any conditioner currently available on the market could be used. For example, according to the present invention, a spring-mounted, wedge-type conditioner, mounted similarly to automotive disc brakes, can be provided. Alternatively, the conditioner could be mounted with a mechanism similar to that used to apply down force for polishing on the wafer, i.e. a hydraulic arm.

Within the scope of the present invention, the semi-conductor wafer can be held to the polishing device in a variety of manners. For example, a semi-conductor wafer carrier can be provided which is capable of pivoting the wafer from a horizontal to a vertical position, to rotate the wafer while in contact with the polishing device, and to apply down pressure to the wafer during polishing. Furthermore, each polishing device can be provided with its own individual carrier. Alternatively, a single tracked carrier can be provided to hold wafers in contact with any of a plurality of polishing surfaces.

The foregoing and other features and advantages of the invention will be apparent from the following more particular description of the preferred embodiments of the invention.

BRIEF DESCRIPTION OF THE DRAWINGS

The preferred embodiments of this invention will be described in detail, with reference to the following figures, wherein like designations denote like elements, and wherein.

DESCRIPTION OF THE PREFERRED EMBODIMENTS

Although the present invention will be described with regard to a wafer polishing pad or belt type polisher, it should be understood that the present invention is equally applicable to other types of polishing machines. Furthermore, it is important to note that the machines in accordance with the present invention are all shown with two polishing units in one device. However, one with ordinary skill in the art should understand that each machine can be provided with one, two, or more polishing units on each machine. For simplicity sake, however, description of the apparatus 1 will be limited to describing only one of the polishing units.

Figure 1:
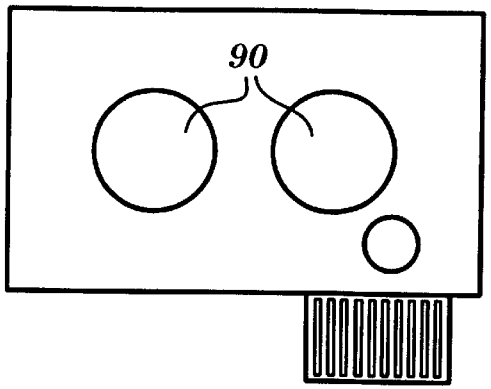
FIG. 1 PRIOR ART
FIG. 1 shows a plan view of a conventional wafer polishing device.
Figure 2:
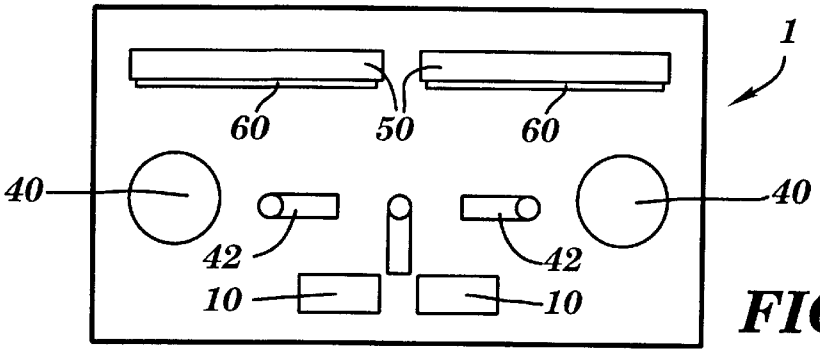
FIG. 2 is a plan view of a polishing pad apparatus in accordance with a first overall embodiment of the present invention.
Figure 4:
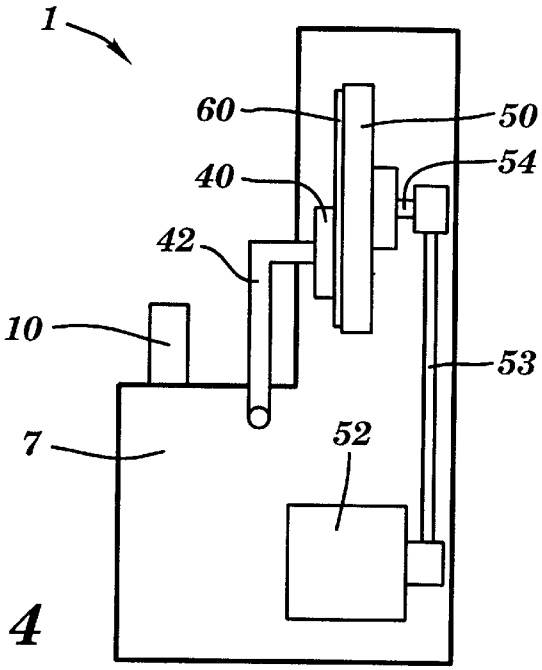
FIG. 4 is a side view of the polishing pad apparatus in accordance with the first overall embodiment of the present invention.

In FIG. 2, a first overall embodiment of the polishing apparatus in accordance with the present invention is shown. In this embodiment, the polishing surface is provided as a polishing pad 60 which is mounted to a substantially vertically-oriented rotatable platen 50, as shown in FIG. 4. The platen 50 is rotatably supported by a substantially horizontal bearing 54 supported by the chassis 7. The platen 50 is driven to rotate by a motor 52 within the chassis 7 of the apparatus via a transmission 53 between the motor 52 and platen 50. The transmission 53 can be in any form which will assure proper power transmission. For example, it is envisioned that the transmission could be in the form of one of a gear mechanism, a belt or a chain.

In order to provide quick access to a supply of wafers which require polishing, the apparatus 1 is provided with a plurality of wafer holders/cassettes 10 which are mounted near the polishing pad 60. Wafers are moved from the cassettes 10 to the wafer carrier 40 by means of a robotic handler (not shown) similar to those commonly found in automated wafer handling equipment. Within the holders 10, wafers are held in a horizontal position for selection. The carrier 40, discussed hereafter, moves the wafers parallel to and in contact with the polishing pad 60. Hence, the holder/cassettes 10 can be utilized to supply the carriers 40 with a supply of wafers which require polishing and also provide for transportability for a set of wafers before and after polishing. For instance, a set of wafers may be placed in a water rinse (not shown) after polishing to subject the wafers to a high pressure water rinse.

Figure 5:
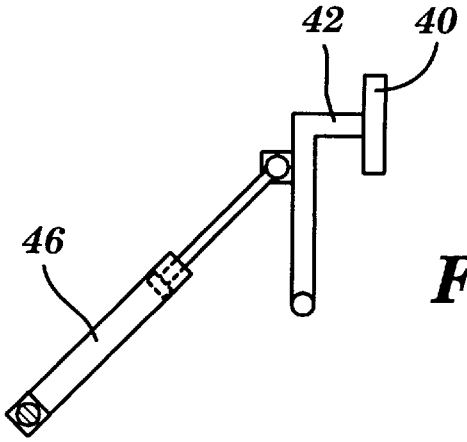
FIG. 5 is a plan view of a semi-conductor wafer carrier in accordance with an embodiment of the present invention.
Figure 11:
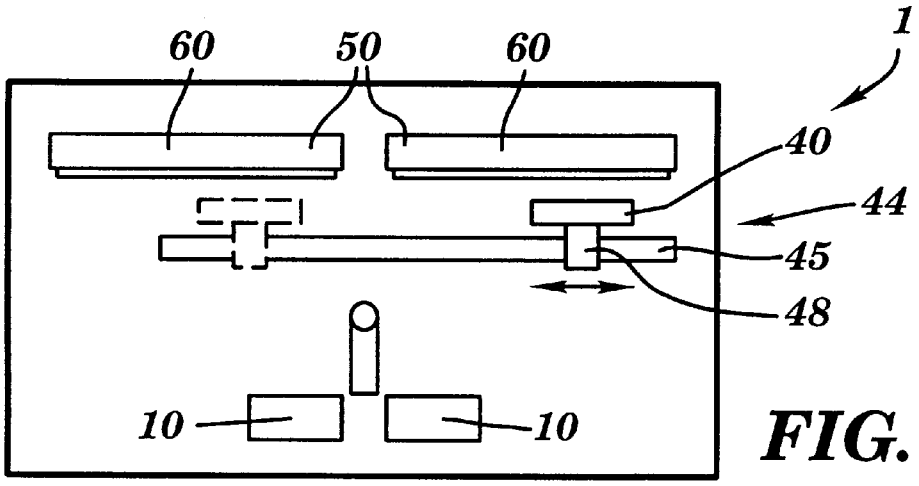
FIG. 11 is a plan view of a polishing pad apparatus in accordance with an alternative carrier transport embodiment of the present invention.
Figure 12:
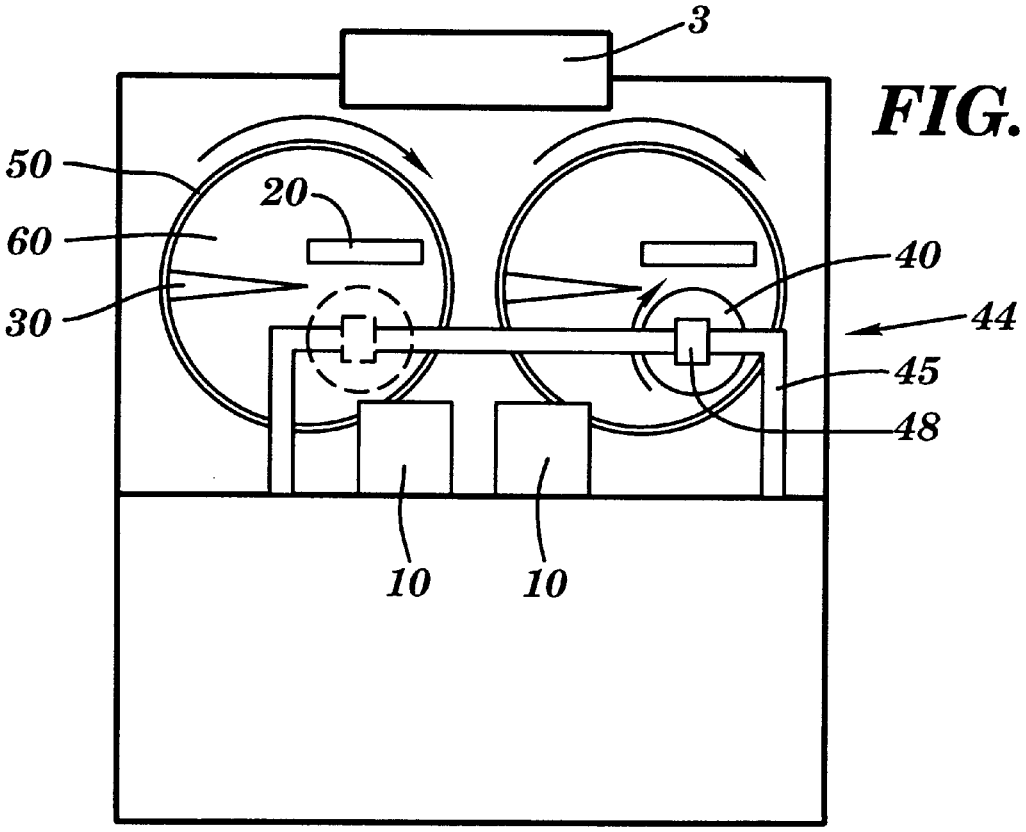
FIG. 12 is a front view of the polishing pad apparatus in accordance with the alternative carrier transport embodiment of the present invention.

The carrier 40, as noted above, is capable of receiving a wafer from the wafer holder/cassette 10 and to hold the wafer parallel and in contact with a polishing area 2 on the polishing pad 60. The carrier 40 can take a variety of conventional forms. For example, as shown in FIG. 5, the carrier can include an arm 42 which is moved via a hydraulic arm 46. Alternatively, a track wafer carrier 44, as shown in FIGS. 11 and 12, may be used to move the wafer into contact with a plurality of side-by-side polishing pads 60. In this embodiment, the carrier 40 may be mounted on a tram 48 that moves along a track 45.

In any form, the carrier 40 is capable of placing pressure on the wafer during polishing. Furthermore, all carriers will be capable of rotating the wafer from a horizontal, their position in the holder 10, to a vertical, the position for polishing. Additionally, all carriers must be capable of rotating the wafer while in contact with the polishing pad 60, i.e. by a geared transmission.

Figure 3:
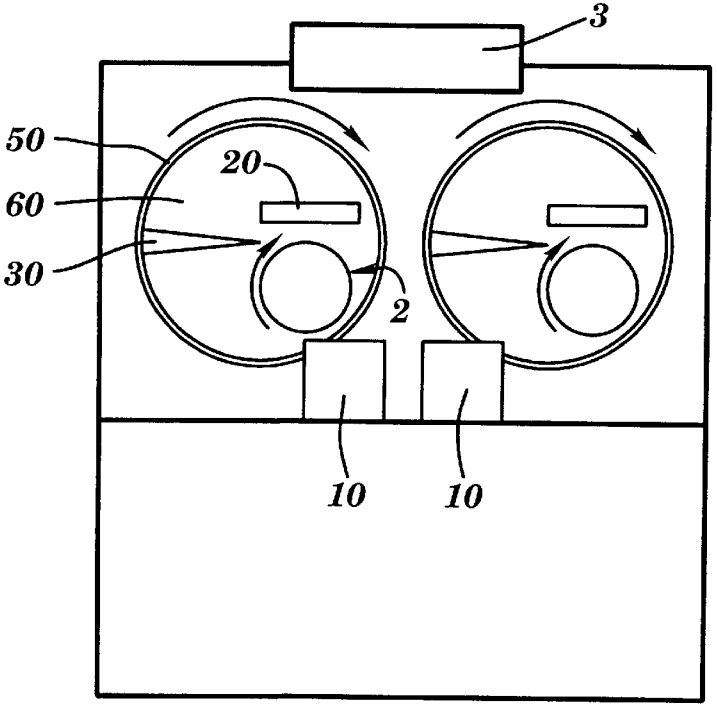
FIG. 3 is a front view of the polishing pad apparatus in accordance with the first overall embodiment of the present invention.
Figure 9:
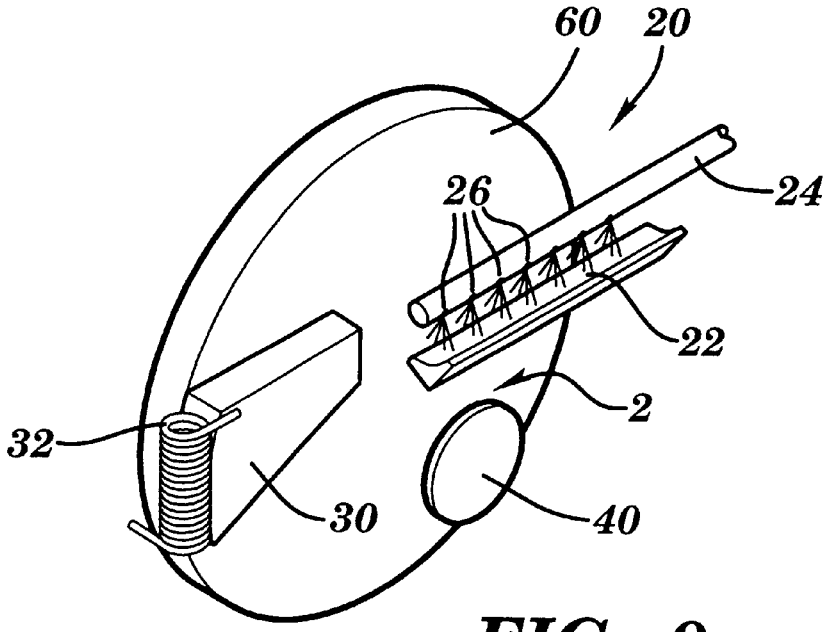
FIG. 9 is a perspective view of a slurry delivery mechanism in accordance with a first embodiment of the present invention.
Figure 10:
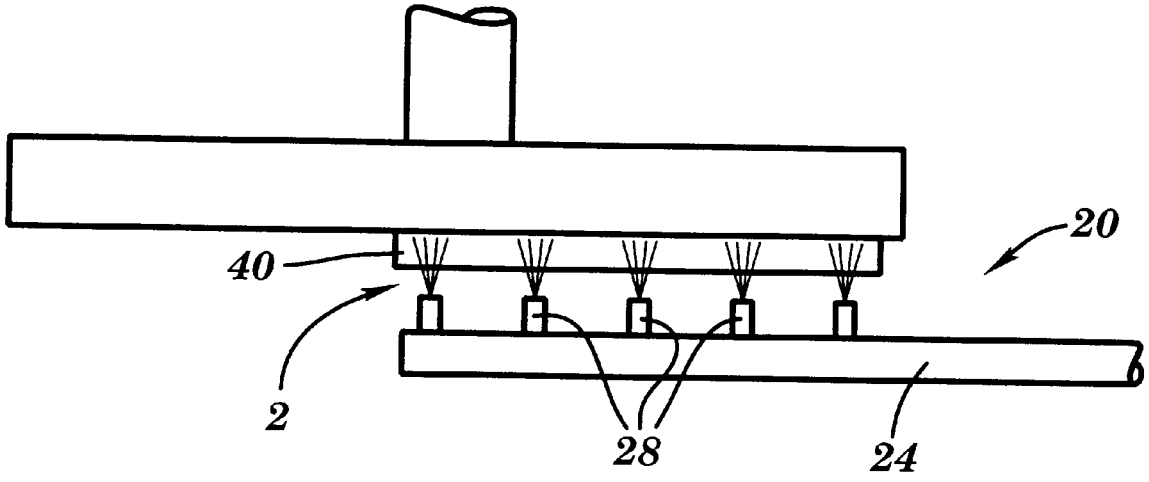
FIG. 10 is a plan view of a slurry delivery mechanism in accordance with a second embodiment of the present invention.

As shown in FIGS. 3, 9 and 10 the apparatus includes a slurry delivery mechanism 20 which assures a coating of low to medium viscosity slurry is provided on the polishing pad to assist in polishing of the wafer immediately preceding the polishing area 2. The slurry delivery mechanism may take a variety of forms. For example, in accordance with one embodiment of the present invention, as shown in FIG. 9, the delivery mechanism can be provided by a slurry conduit 24 having at least one outlet 26 in which slurry drops onto the polishing pad. As an alternative, as shown in FIG. 10, the delivery mechanism may be provided by at least one spray nozzle outlet 28 on the conduit 24. In this embodiment, the slurry is sprayed onto the pads 60. In either of the above embodiments, an optional squeegee 22, shown only in FIG. 9, may be provided in order to assure an even coating radially across the polishing pad 60. In the case that the slurry drops onto the pad, slurry may also drop onto the squeegee 22, for spreading evenly onto the pad 60.

In order to clean/condition the pad 60, as shown in FIGS. 3 and 9, a spring-loaded conditioning module 30 may be provided in an area encountered after the polishing area 2. One type of conditioner which may be employed is a wedge-type conditioner which is biased against the pad by a spring 32 similarly to disc brakes. It should be noted, however, that any conventional conditioner which provides for the cleaning and conditioning of the polishing pad 60 may be employed.

Figure 6:
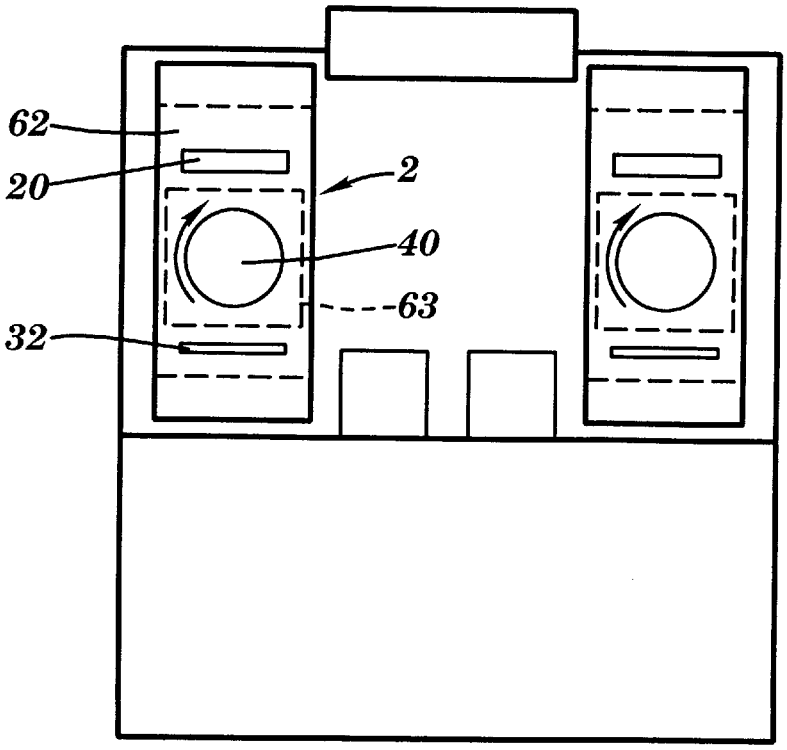
FIG. 6 is a front view of a belt polishing apparatus in accordance with a second overall embodiment of the present invention.

As a second overall embodiment in accordance with the present invention, as shown in FIG. 6, the polishing surface may be provided as a belt type pad 62. In this embodiment, a platen in the form of a belt supporting plate 63 is provided behind the revolving belt 62 to support the belt in the polishing area 2. In this embodiment, the slurry delivery system is also mounted so as to assure an even coating of slurry on the belt and the polishing area 2. Similarly, to the first overall embodiment, a conditioning module 32 can be provided in an area encountered by the belt after the polishing area 2.

Figure 8:
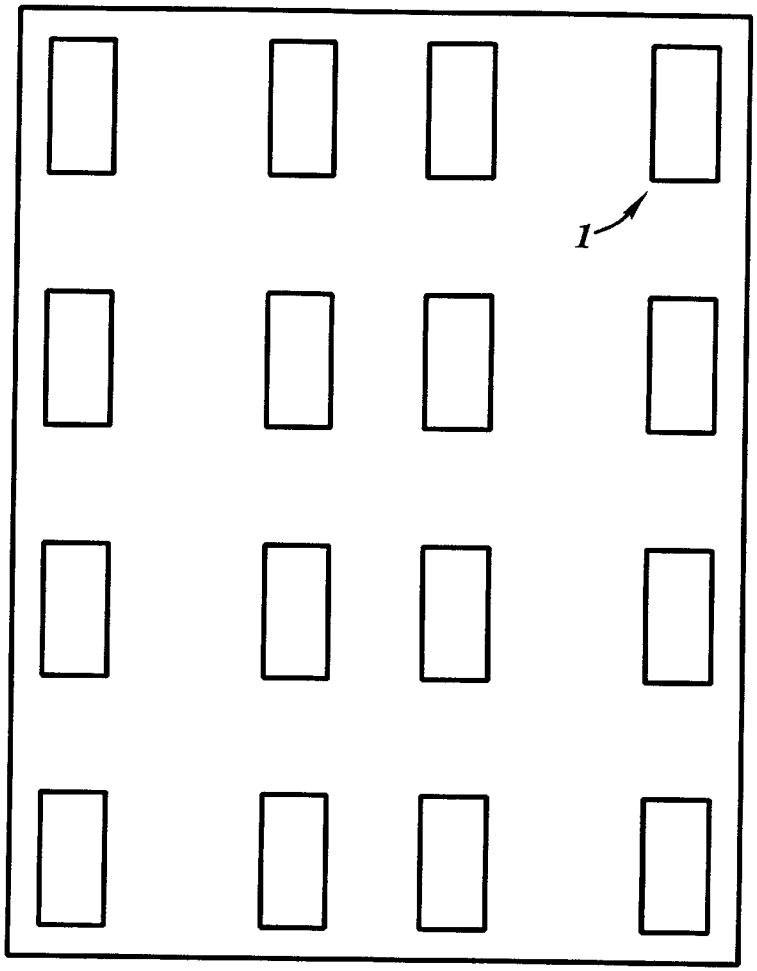
FIG. 8 is a plan view of a wafer polishing area on a manufacturing floor in accordance with the present invention.
Figure 7:
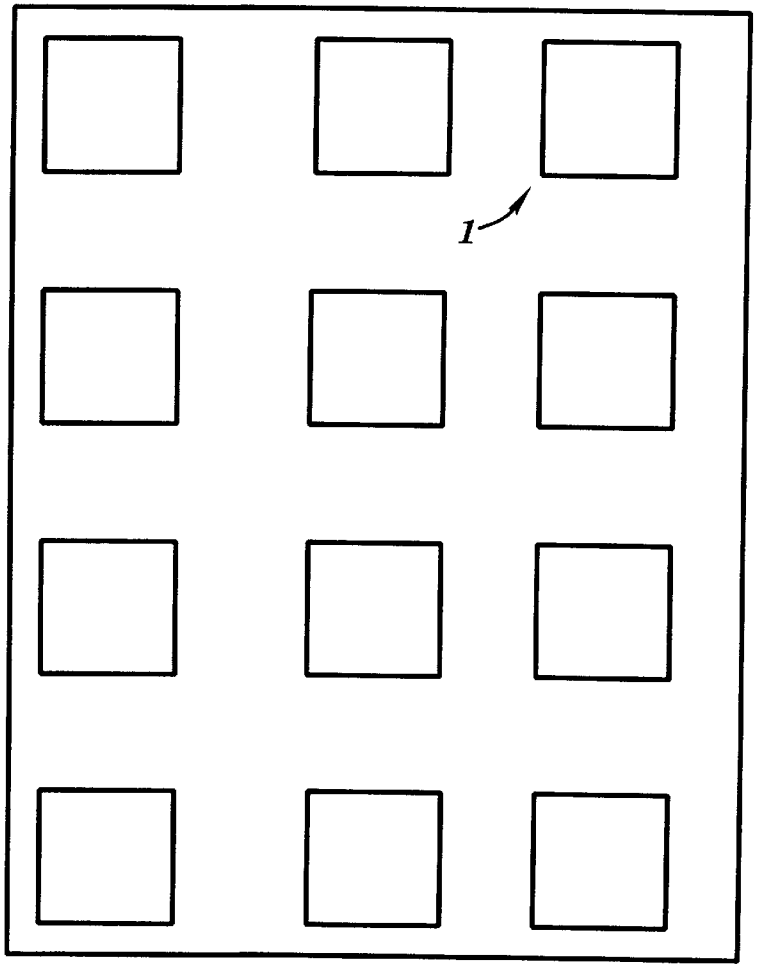
FIG. 7 PRIOR ART
FIG. 7 is a plan view of a conventional wafer polishing area on a manufacturing floor.

FIG. 7 discloses a plan view of a conventional wafer polishing area on a manufacturing floor and FIG. 8 shows the same view but in accordance with the present invention. As illustrated by comparing FIGS. 7 and 8, due to the decreasing of the footprint of the polishing apparatus by making the polishing surface vertical, a reduction in the depth of each polishing apparatus can be achieved. This reduction can be up to 50% of the depth of predecessor polishing devices. As a result, up to a 33% increase in the number of apparatuses in a given manufacturing area can be recognized. Accordingly, the polishing step of semiconductor wafer manufacture can be of higher quality and more efficient.

While this invention has been described in conjunction with the specific embodiments outline above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

We claim:

1. An apparatus comprising:

at least one polishing device including at least two substantially vertical polishing surfaces, each polishing surface receiving a separate semiconductor wafer in a polishing area of the polishing surface; and a slurry delivery mechanism to deliver slurry onto each of the vertically-oriented polishing surfaces.

2. The apparatus of claim 1, further including a wafer holder for each polishing surface, and wherein each wafer holder vertically holds at least one semiconductor wafer.

3. The apparatus of claim 1, further including means for holding a semiconductor wafer in contact with and parallel to each polishing surface in the polishing area.

4. The apparatus of claim 3, wherein the means for holding a semiconductor includes a tracked wafer carrier to hold a semiconductor wafer at each of the polishing surfaces.

5. The apparatus of claim 3, wherein the means for holding a semiconductor wafer includes a wafer carrier for each polishing surface.

6. The apparatus of claim 3, wherein the means for holding a semiconductor wafer includes means for applying pressure to the wafer.

7. The apparatus of claim 6, wherein the means for applying pressure is a hydraulic cylinder.

8. The apparatus of claim 3, wherein the means for holding a semiconductor wafer includes means for rotating the wafer from a horizontal position to a vertical position parallel to the polishing surfaces.

9. The apparatus of claim 3, wherein the means for holding a semiconductor wafer further includes means to horizontally translate the wafer with respect to the polishing device.

10. The apparatus of claim 3, wherein the means for holding a semiconductor wafer includes means for rotating the wafer while in contact with the polishing device.

11. The apparatus of claim 6, wherein the means for rotating the wafer includes a geared transmission.

12. The apparatus of claim 1, further including at least two polishing devices.

13. The apparatus of claim 1, wherein the slurry delivery mechanism has at least one outlet immediately preceding each polishing area.

14. The apparatus of claim 13, wherein the at least one outlet is immediately above the polishing area.

15. The apparatus of claim 13, wherein the at least one outlet is a spray nozzle to spray the slurry onto each of the vertically-oriented polishing surfaces.

16. The apparatus of claim 13, further including:

a squeegee mounted immediately adjacent each polishing surface to spread the slurry evenly across each of the polishing surfaces; and wherein the at least one outlet allows slurry to drip onto a squeegee for spreading on each of the polishing surfaces.

17. The apparatus of claim 16, wherein the at least one polishing device is a polishing pad and the squeegee is positioned to assure coating of the slurry radially across the pad.

18. The apparatus of claim 1, wherein the slurry is a low to medium viscosity slurry.

19. The apparatus of claim 1, wherein each polishing surface is a belt type polishing surface.

20. The apparatus of claim 1, wherein each polishing surface is a polishing pad.

21. The apparatus of claim 1, wherein each polishing surface is supported by a platen.

22. The apparatus of claim 21, wherein each polishing surface is a polishing pad.

23. The apparatus of claim 22, wherein the platen is substantially circular and rotatably supported by a bearing to hold the platen substantially vertical.

24. The apparatus of claim 23, wherein the platen is rotatably driven by a motor through a transmission.

25. The apparatus of claim 21, wherein each polishing surface is a belt type polishing surface and the platen is a belt supporting plate.

26. The apparatus of claim 1, further including a means for conditioning the at least one polishing device adjacent the polishing area.

27. The apparatus of claim 26, wherein the means for conditioning is a spring-loaded wedge conditioner.

28. A method of polishing a semiconductor wafer comprising the steps of:

providing a polishing device having at least two substantially vertical polishing surfaces;

polishing at least one distinct semiconductor wafer on each polishing surface; and applying a slurry onto the substantially vertical polishing surfaces.

29. The method of claim 28, wherein the step of applying a slurry includes spraying the slurry onto the polishing surfaces.

* * * * *